US007285032B2

(12) United States Patent
Cha

(10) Patent No.: US 7,285,032 B2
(45) Date of Patent: Oct. 23, 2007

(54) FLYING DISK RESCUE DEVICE

(76) Inventor: Michael Joon Cha, 4 Adrian Way, River Edge, NJ (US) 07661

( * ) Notice: Subject to any disclaimer, the term of this patent is extended or adjusted under 35 U.S.C. 154(b) by 113 days.

(21) Appl. No.: 11/325,958

(22) Filed: Jan. 5, 2006

(65) Prior Publication Data

US 2007/0155263 A1 Jul. 5, 2007

(51) Int. Cl.
*B63B 35/58* (2006.01)

(52) U.S. Cl. ..... 441/81

(58) Field of Classification Search ..... 441/81
See application file for complete search history.

(56) References Cited

U.S. PATENT DOCUMENTS 2,109,813 A * 3/1938 Winckler ..... 441/18
4,416,640 A * 11/1983 Eickenhorst ..... 441/81
5,562,512 A 10/1996 Samelian ..... 441/84
5,895,299 A 4/1999 Hyde ..... 441/84
6,257,942 B1 * 7/2001 Groover ..... 441/84
6,413,134 B1 7/2002 Wahl et al. ..... 441/84

* cited by examiner

*Primary Examiner*—Jesus D Sotelo

(57) ABSTRACT

A hand thrown flying disk used in rescuing individuals in distress comprising of a length of line (10) of which one end is connected to an anchoring clip (11) and a handle (14). With the use of double sided adhesive pads (28 & 24) the other end is spirally wound on top of the cover (26) and the disk (18). A loop (27) is attached to the line which allows for the removal of the cover when the disk is thrown. The end of the line is then fed through the hole on the top (22) and then terminated by weaving it through the holes on the side (23). The end is secured by tucking the end into the weaving. The hole (20) provides for an easy grabbing point.

15 Claims, 5 Drawing Sheets

FLYING DISK RESCUE DEVICE

BACKGROUND—FIELD OF INVENTION

This invention relates to a hand thrown flying disk that is used to rescue individuals from water or thin ice.

BACKGROUND—DESCRIPTION OF PRIOR ART

There have been many instances of individuals who were in distress in and around water. These emergencies are more prevalent in cases of rapid moving water, where the individual cannot swim fast enough to fight the water current. Even a low depth but swift moving water has the power to sweep away individuals. There have also been many cases of individuals falling into thin ice.

Most rescues of such emergencies are performed by local fire department or special rescue units. Many times the police officer is first to arrive at the emergency, but they lack the tool or training to perform the rescue. In waiting for the fire department or special rescue unit, valuable time is wasted. Specially, when the victim is in swift moving water, their location can change within a short period of time. Moreover, while the victim is in water, the individual can suffer from hypothermia, thus loosing their strength as well as mobility. This will hamper the individual ability to take action on him or herself, and the victim will be more dependent on the rescuer.

Devices such as a throw bag and life ring are commonly used for water rescue. A throw bag comprises of a bag with rope wound inside of the bag, where one end is attached to the bag and the other end is retained by the use. The rescue ring is a donut shaped floatation device where one end of the rope is attached to the ring and the other end is retained by the user. These devices have to be thrown underhand, using a windmill motion of the arm. These devices are bulky and very difficult to throw. They lack the aerodynamic shape to their property, and are difficult to get accurate throws.

A use of a flying disk is a more accurate way to deploy a safety line. Rescue devices shown in U.S. Pat. No. 5,562,512 (1996), U.S. Pat. No. 5,895,299 (1999) and U.S. Pat. No. 6,413,134 (2002) all describe a rescue device with a circular disk shaped object with a line tethered to the disk. Although the three devices use the aerodynamic property of a flying disk to reach the person in distress, many design elements make it inefficient and harder to use.

The throwing motion of a circular disk will initially create the fastest rotation on the disk. As the disk travels further away, the rotational speed diminishes. Too much or too little tension on the line can adversely affect the flight of the disk. For optimum result, the dispensing of the line off the disk has to be perfectly matched with the rotation of the disk, or be independent from the rotational action. U.S. Pat. Nos. 5,562,512, 5,895,299 and 5,895,299 all have an outer flanges or lower cavity where the line is dispensed. All three inventions describe the line being spooled around a channel located on the outer flange or lower cavity. If the rotational speed of the disk is not sufficient enough to match the dispensing of the line, this will create too much tension on the line. The tension on the line will hold back the rotation of the disk, and will push the disk away from the intended direction of throw. If the rotation speed of the disk is too much, it will dispense the line too quickly and will increase the chance of the lines tangling up.

U.S. Pat. Nos. 5,562,512, 5,895,299 and 5,895,299 have a line that is circularly wound on the outer flanges or lower cavity. This dictates that the disk can only be thrown in one direction. If the line is wound in a clockwise direction, it can only be thrown by the right hand. Similarly, if the line is wound in a counterclockwise direction, it can only be thrown by the left hand. The above mentioned Patents are right or left handed specific and are not universal for all users.

Often when an individual has fallen into rapid moving water and/or thin ice, the victim may suffer from hypothermia. The individual will loose mobility and strength to hold onto rescue devices with the hands. U.S. Pat. Nos. 5,895,299 and 6,413,134 describe a circular shaped disk without any hole. The surface of a purely circular shaped disk is difficult to grab onto. When suffering from hyperthermia, the arms and legs want to be drawn into the body to save heat. The hands start shivering. Trying to use the hands to hold onto the rescue devices is difficult. It is more efficient to loop a part of the rescue device around the arm and use the natural tendency of the arm to draw towards the body to hold onto the rescue device. Both U.S. Pat. Nos. 5,895,299 and 6,413,134 lack a design feature that allows an arm to be loop around any of the components of the rescue device.

To achieve the longest distance and softest landing of the flying disk, the user throws it higher than the location of the target. The disk travels upward until the force of gravity brings the disk downward. In this instance the leading edge of the disk is pointed higher than the trailing edge of the disk. This attack angle tries to stay the same during the entire flight, due to the gyroscopic action of the spinning disk. If you draw a straight line from the thrower hand and to the point on the disk where the thrower can consistently view the same point, you will spot the center of the top of the disk. This is the optimum point from which the line can be unfurled, because at this point no other part of the rotating disk is touching the path of the line. If the line is touching any part of the disk while it is being thrown, it will create friction. Friction will adversely diminish distance and accuracy of the throw. U.S. Pat. Nos. 5,562,512, 5,895,299 and 6,413,134 all describe disks that dispense the line from a flange or a cavity located on the side or the bottom of the disk. During the flight of the disk, the line is being unfurled at the side or the backside of the disk. With the trailing edge of the disk tilting downward during flight, the line will rub against the upper section of the flange or the cavity. This added friction and will diminish the distance and accuracy of the throw.

Flying disk has been used as recreational toy for many years. Frisbee ™ is a well known flying disk toy that has a proven optimal shape and proportion for flight. It is flat, thin, and has a peripheral lip that curves down. It also has a smooth and curved outer edge. Design of flying disks toys allows for easy grip when throwing. When throwing most flying disk toys, the thumb is place on the top portion of the outer peripheral edge. The thumb is placed on the top surface that is flat, and fairly parallel to the length of the disk body. The rest of the fingers are placed on the lower portion of the outer peripheral edge and curved up to grab onto the peripheral lip. The grip of the disk should be comfortable and secure. The act of gripping should not interfere with the dispensing of the line. U.S. Pat. Nos. 5,562,512, 5,895,299 and 6,413,134 all describe a disk shaped device, but its proportions are dissimilar to most of the toy flying disk design. In the attempt to provide space for the line and a buoyant mass, the designs of the above mention Patents have lost some of the aerodynamic properties. U.S. Pat. No. 5,562,512 describes a rescue disk that has a flat bottom to the disk body. There is no peripheral lip for the fingers to curve up and grab onto. All three above mentioned patents have a curved top surface. The location, where the thumb would be placed to hold onto the disk is angled. This point is not parallel to the length of the body. In the act of throwing the disk, the thumb may slip and a secure grip on the disk may be lost. U.S. Pat. Nos. 5,562,512 and 5,895,299 both have an outer flange, where the line is retained. There is no smooth outer edge to the disk body. The protruding outer flange takes away form the aerodynamic property of a flying disk. U.S. Pat. No. 6,413,134 has a lower cavity, where the line is retained. In the act of holding the disk body, the fingers are in contact with the wound line. The line should not be disturbed when the line is being dispersed. It may cause greater chance of the line getting tangled up. Although buoyancy is important to the design of the rescue disk, it should not be one of the priorities to the design. The rescue disk should be buoyant enough not to sink. The material makeup of the disk and line makes the disk fairly neutrally buoyant. Additionally buoyant line can be used to increase buoyancy. The prime goal of a tethered disk based rescue device should be to quickly and safely pull the person out of distress, not to provide buoyancy. U.S. Pat. Nos. 5,562,512, 5,895,299 and 6,413,134 all describe a disk shaped devices with air chambers and/or made of buoyant materials that make up a substantial portion of the disk body. Over emphasis on buoyancy design takes away form aerodynamic properties.

Line used in rescue devices has to be strong enough to pull the weight of the individual in distress out of water or over ice. Often individual in distress are in rapid moving body of water. The movement of water will increase the force needed to pull the individual out of distress. Often the moisture retained by the clothing will make the individual in distress heavier. Similar to climbing ropes, the lines on a throw able rescue device should have a built in safety margin of at least four times the expected load. The expected load is also determined by the pulling limit of one rescuer. In cases of rapid moving water the pulling force needed should not exceed 200 pounds. If it exceeds that amount, the rescuer might be in danger of being dragged into the water, if he or she forgets to let go of the end of the line or is not able to anchor the end of the line in time. Currently sold 4 mm Nylon sheath/Nylon core accessory cord has a breaking load of about 900 lb and a comparable 5 mm cord has a breaking load of about 1,200 lb. This exceeds the safety margin of four times the expected limit of 200 pounds. There might be instances where more than one person is rescued at the same time or the victim is being rescued in extremely rapid flowing water. Although not recommended, the 200 ponds limit can be exceeded, as long as it does not go over the breaking load. Four and five millimeter thick cords are an ideal minimum thickness for use in this type of water rescue application. Most commercially available throw bags come with 50 to 70 feet of line. This is an ideal length for water rescue. U.S. Pat. No. 5,895,299 has a peripherally arranged flange where the line is wound. The flange does not provide for the recommended 50 to 70 feet of four to five millimeter line. The flange depth and height can be increased, but that will take away from the aerodynamic property of a disk. One of the variations to U.S. Pat. No. 5,562,512 claim to have been wound with ¼ inch diameter nylon rope, which meets the minimum four to five millimeter ideal cord thickness. The disk is fat and does not have a comfortable spot for the hand to grab onto. The disk does not mirror the proven proportions of the flying disk toy. U.S. Pat. No. 5,562,512 states that it was wound with 3/16 inch thick line. In providing space for the line, the disk is fat and very difficult to hold onto. It also does not mirror the proven proportions of a flying disk toy.

U.S. Pat. No. 5,895,299 describes a disk shaped device that is comprised of multiple pieces that are sealed together to create the flange and the air space. The cementing of multiple pieces can create weak joint, where failure can occur. Furthermore the process of combining multiple pieces is much more expensive to construct than just having one main body piece. Most of the variations of the U.S. Pat. No. 5,562,512 describe a disk shaped device that is made up of numerous pieces. Certain components are thinner walled, thus making it weaker than other components of the invention.

During the deployment of the disk shaped rescue devices, the rescuer must retain the end of the line. After the person in distress grab onto the thrown disk, the line will take on additional tension. It should be easy for the rescuer to hold onto the line. Just grabbing the line with the hand and pulling the line in with the hands can put excessive strain on the hands. It is also beneficial if the rescuer can anchor the end of the line onto a stable anchoring point, such as a tree, fence or a rock. This will free the rescuer from holding back the bulk of the tension force. The rescuer can then get closer to the person in distress and assist in pulling the person in distress out of water. If the terrain toward the body of water is rough, the rescuer can also hold onto the line while approaching the person in distress. U.S. Pat. Nos. 5,895,299 and 6,413,134 does not provide any apparatus for helping to retain or anchor the line. U.S. Pat. No. 5,562,512 describes a small circular ring that is attached to the end of the line. This is not sufficient enough to comfortably hold onto the end of the line. The circular ring can only be anchored, if an addition of a clip or a hook is used.

Water rescue may occur at any time of the day. A rescue might be performed when there is little or no sun light. In instances like this, the person in distress might have trouble seeing the rescue device being deployed. It is also beneficial for the rescuer to see where the rescue device has landed. If the device was thrown past the victim, the rescuer can quickly pull the line in so that the disk portion of the rescue device is closer to the person in distress. U.S. Pat. Nos. 5,562,512, 5,895,299 and 6,413,134 all describe a disk shaped rescue devices. These patents do not stipulate any design criteria addressing the issues of visibility during low light conditions. They do not describe the use of glow in the dark, fluorescent or light reflective materials. They do not describe the use of electronic light components.

OBJECTS AND ADVANTAGES

Accordingly, several advantages of the invention are:

(a) to provide a rescue device that uses the aerodynamic property of a flying disk to dispense a line to a person in distress;

(b) to provide a rescue device where the dispensing of the line minimally affects the path of the flight;

(c) to provide a rescue device that can be thrown right or left handed;

(d) to provide a rescue device that minimize the entanglement of the line being dispensed;

(e) to provide a rescue device that accommodate for the proper thickness line to be used in rescue situations;

(f) to provide a rescue device that is easily grabbed and held onto by the person being rescued, especially those who may be suffering from hyperthermia;

(g) to provide a rescue device that is easily held onto and thrown by rescuer, to achieve accurate delivery.

Other objects and advantages are;

(h) to provide a rescue device that one person can deploy with speed;

(i) to provide a rescue device that can be used to rescue individuals who has fallen into thin ice;

(j) to provide a rescue device where the end of the retained line can easily be anchored to numerous objects;

(k) to provide a rescue device where the user can easily hold onto the end of the retained line without putting excessive stress on the hand;

(l) to provide a rescue device that may be made of florescent, reflective and/or glow in the dark materials to provide additional visibility during low light conditions;

(m) to provide a rescue device that provide incorporation of LED, circuitry, switch and batteries to provide lights for added visibility during low light conditions;

(n) to provide a rescue device that is reusable and easily maintained, and (o) to provide a rescue device that is inexpensive and economical to make.

Additional objects and advantages of the invention will be apparent from the considerations of ensuing description and drawings.

DRAWING FIGURES

Figure 8:
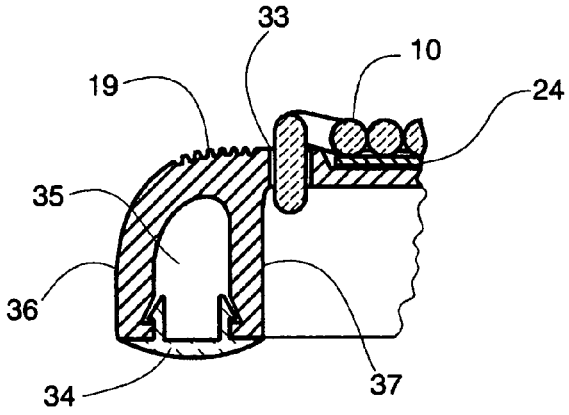
FIG. 8 shows partial cross section of the disk using a cap to create additional buoyancy. This view is of the additional buoyancy version of the invention.
Figure 9:
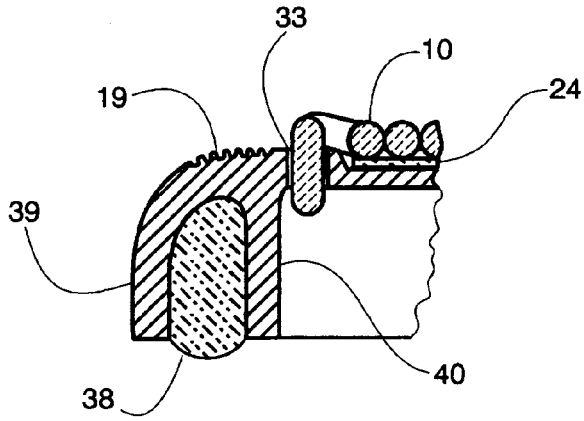

FIG. 9 shows partial cross section of the disk using an insert to create additional buoyancy. This view is of the additional buoyancy version of the invention. The section plan is same as in FIG. 8.

Figure 10:
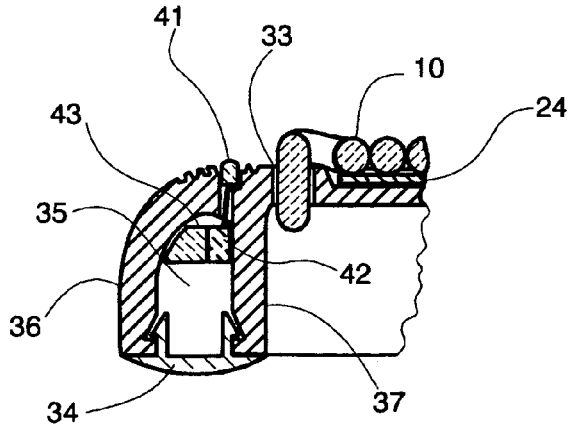

FIG. 10 shows partial cross section of the disk that incorporates the use of electronics to provide additional visibility. This view is of the additional buoyancy version of the invention. The section plan is same as in FIG. 8.

SUMMARY

In accordance with the present invention a hand thrown flying disk that is used to rescue individuals from water or thin ice, comprising of a disk having a top surface; and a length of line continually spiral wound on the top of the disk, wherein the length of line is connected to the disk at a first end and retained by a user at a second end thereby the length of cord is automatically dispensed when the object is thrown to a target. In accordance with yet another aspect of the present invention the disk shall include a hole, enabling a person to easily grab onto the disk.

Other and further aspects of the present invention will become apparent during the course of the following detailed description and by reference to the attached drawings.

DESCRIPTION

Figure 6:
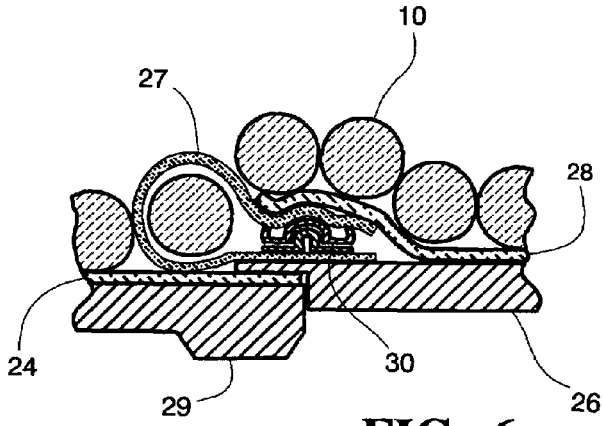
FIG. 6 shows detailed partial cross section view of the cover and disk. The section plane is same as in FIG. 4.

A typical embodiment of the invention is illustrated in FIG. 1-5. A variation of the invention, which provides additional buoyancy, is illustrated in FIG. 7-10. FIG. 6 can apply to typical and additional buoyancy options.

Figure 2:
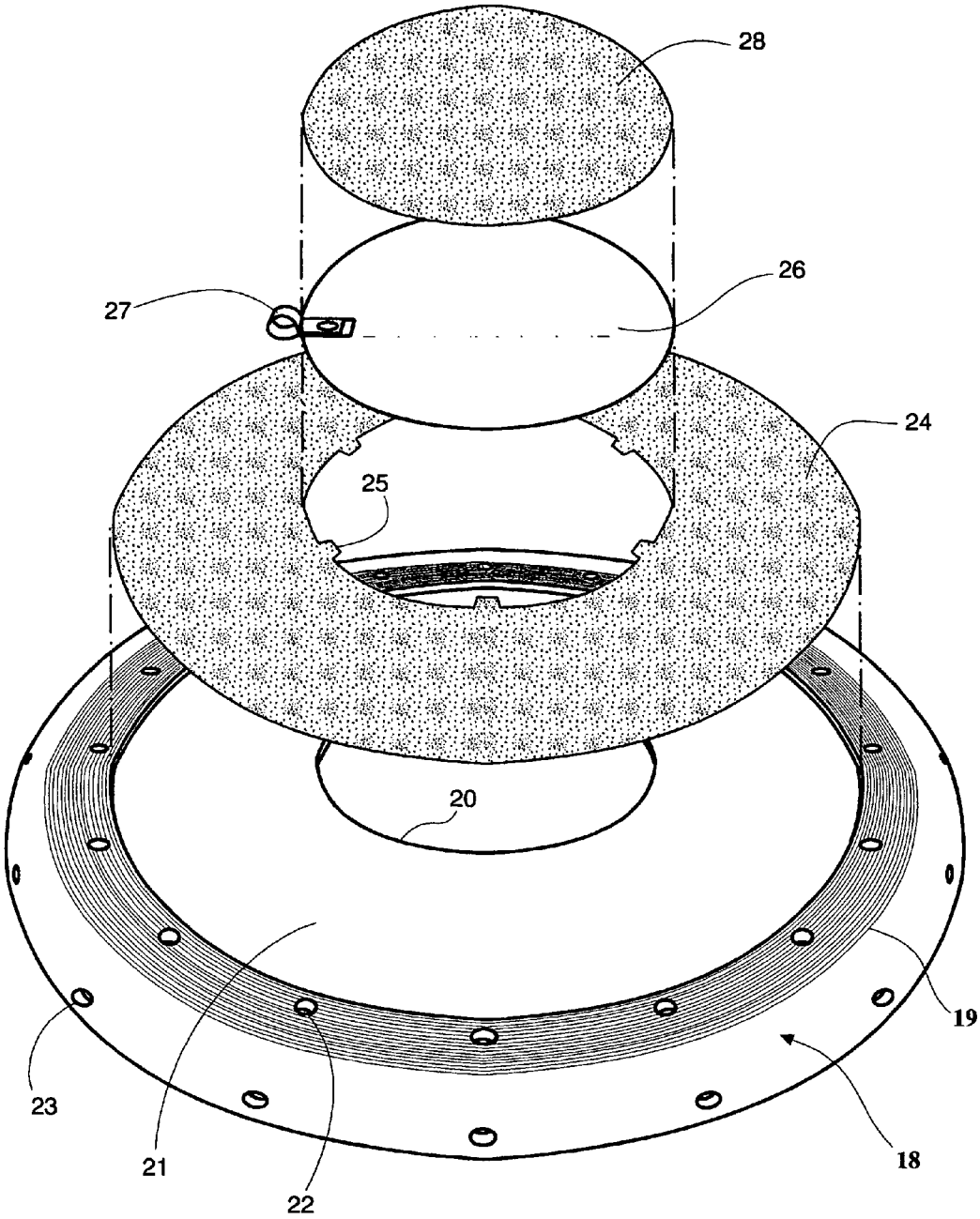
FIG. 2 shows the exploded perspective view of the disk assembly shown without the line attached.
Figure 3:
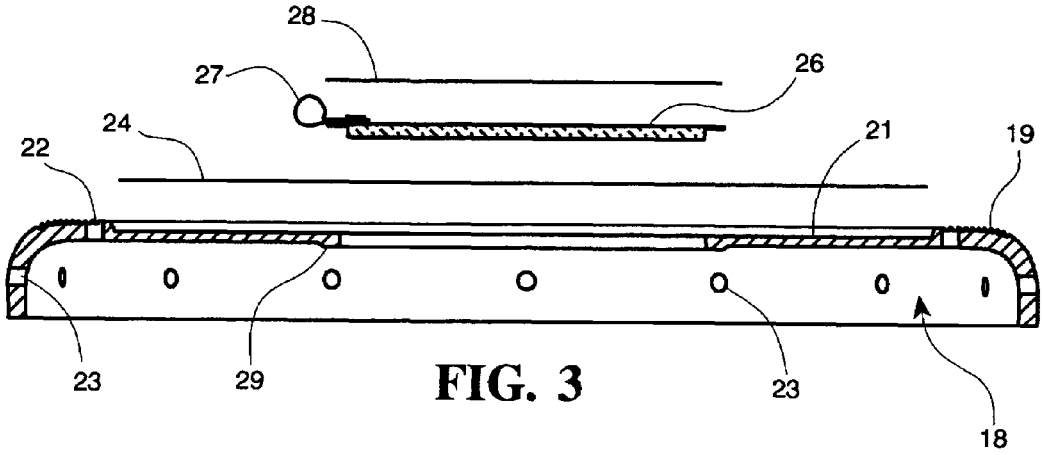
FIG. 3 shows the exploded section view of the disk assembly without the line attached. The section plane is same as in FIG. 4.
Figure 4:
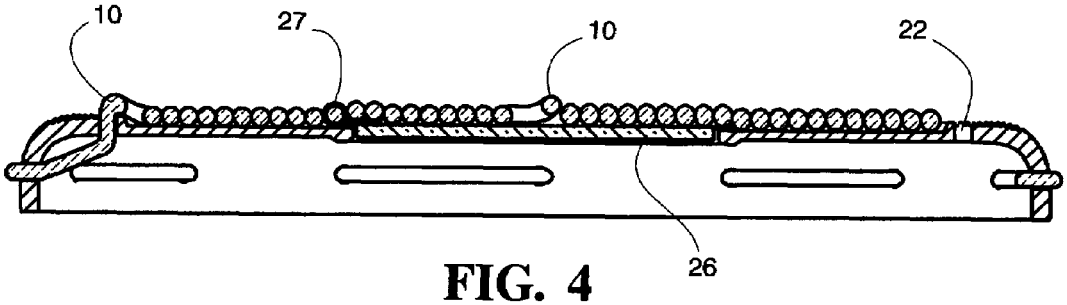
FIG. 4 shows the cross section view of the disk assembly with the line attached.
Figure 5:
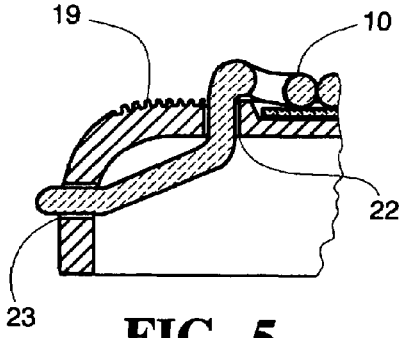
FIG. 5 shows the partial cross section view of the disk. The section plane is same as in FIG. 4.

FIG. 2 illustrates an exploded perspective view of a disk assembly, shown without a line attached. A double sided adhesive pad 24 is attached to a top surface of disk 21. Tabs 25 are protruding out from the inside edge of the double sided adhesive pad 24. A cover 26 is then placed on top of tabs 25. A cover 26 entirely covers a hole 20. The tabs 25 provide just enough adhesion to hold a cover 26 in place. If there is too much adhesion between the cover 26 and tabs 25, the numbers of tabs 25 can be diminished. A double sided adhesive pad 28 is placed on top of a cover 26. This assembly provides a sticky flat surface for a line 10 to be spirally wound. During the motion of the throw, the force of the unwinding line 10 separates the cover 26 from the tabs 25 and the top surface of disk 21.

Figure 1:
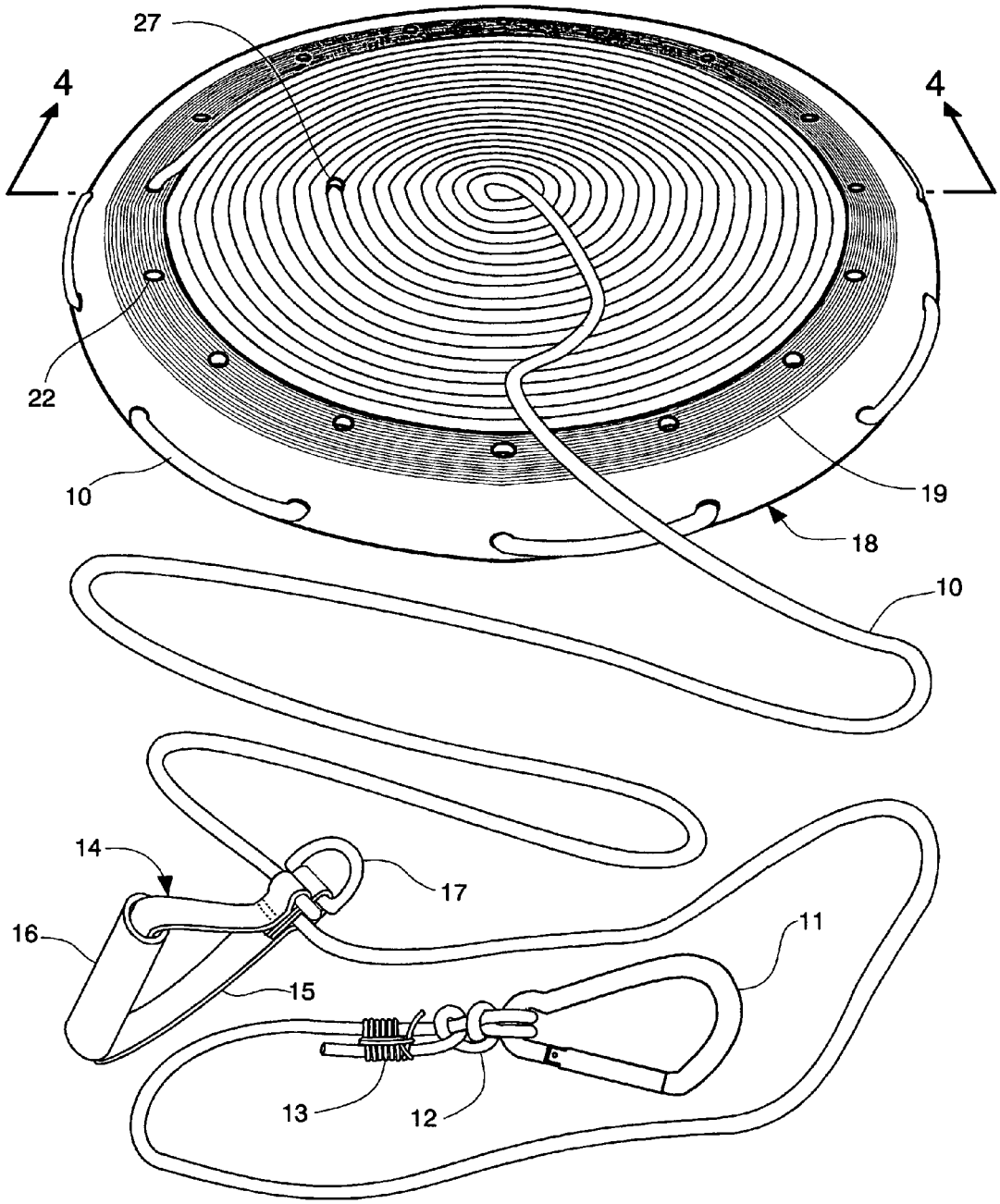
FIG. 1 shows a perspective view of the entire invention.

In FIG. 1, one end of the line 10 is attached to a clip 11 by using a knot 12 and then secured on by using a seizing 13. Further more; a tape wound around the end can also be used. The seizing 13 prevent the knot 12 from being undone accidentally. The seizing 13 can also be covered up with a shrink wrap. A handle 14 is attached to the line 10. The handle 14 comprises of a tube 16, a strapping 15 and a ring 17. The strapping 15 is threaded through a tube 16. The tube 16 provides a comfortable grip and a non slip surface. The tube 16 also provides an opening in the handle where the user can quickly grab onto. The tube 16 can be made of any variety of materials, such as foam, foam rubber, vinyl, nylon, rubber, leather, various impregnated or laminated materials, various plasticized materials, cardboard, paper, etc. The tube 16 can be omitted, and the handle will still function. The end of the strapping 15 is folded over the line 10 and the ring 17. The strapping 15 is then sewn together. The end of the line 10 with the clip 11 can be wrapped around an anchoring point, such as a tree. The ring 17 provides a point for the clip 11 to attach to. The clip 11 can also be attached to other anchoring point directly.

The length of line 10 is spirally wound from the center of the double sided adhesive pad 28. A reposition able and paintable adhesive can also be used instead of the double sided adhesive pads 28 and 24. A reposition able and paintable adhesive can also be applied on top of the double sided adhesive pads 28 and 24, to increase adhesion. This can be beneficial in case where the invention was deployed and the line 10 need to be rewound. The tack on the double sided adhesive pads 28 & 24 hold the spirally wound line 10 in place. In FIG. 1, the line 10 is shown spirally wound in a counterclockwise direction. Although the disk can be thrown by either a left handed or a right handed thrower, a clockwise wound disk assembly is optimum for a left handed thrower and a counterclockwise wound disk assembly is optimum for a right handed thrower. There is slightly less twisting of the line when this formula is followed. The disk can be wound in accordance to the primary user. Grooves 19 are placed concentrically on the outer edge of the disk 18 to give additional grip when the disk is held onto and thrown.

When the spirally wound line 10 reaches the edge of the double sided adhesive pad 28, the line 10 is attached to a loop 27. This can be achieved by threading the end of the line 10 through the loop 27. This could also be achieved by unsnapping a snap fastener 30, placing the line 10 into the loop 27 and then reattaching the snap fastener 30. The line 10 is continuously spiral wound on top of the double sided adhesive pad 24. The line 10 is continuously spiral wound until the line 10 reaches the edge of the double sided adhesive pad 24. At a nearest hole on top 22, the line 10 is threaded through a hole on top 22. The line 10 is then threaded through a corresponding hole on side 23 in the same direction as the spiral wound. The line 10 is then woven through the adjacent holes on side 23. The line 10 is continuously weaved until the slack on the line 10 is only about three to four inches. The end of the line 10 is then tucked under the underside of the weaving. The line 10 can also be continuously weaved through holes on top 22.

Figure 7:
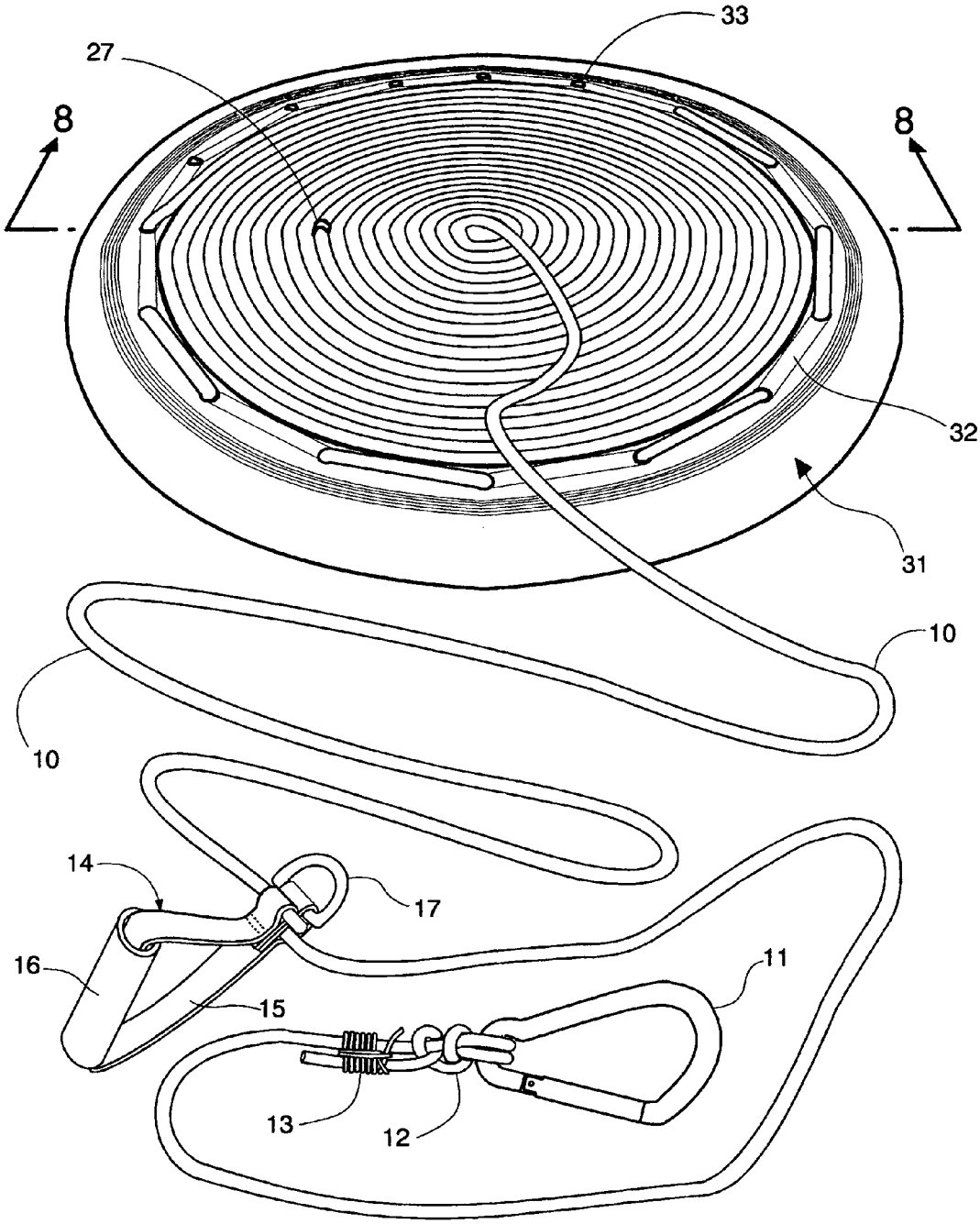
FIG. 7 shows perspective view of the entire additional buoyancy version of the invention.

There are two variations of the invention that adds additional buoyancy. This is illustrated in FIG. 7-9. In FIG. 7, the line 10 is similarly spiral wound on top of the disk 31 body. In FIG. 8-9, once the cord 10 reaches the edge of the double sided adhesive pad 24, the remaining length of cord 10 is threaded through a nearest hole on top 33. In FIG. 7, the remaining cord 10 is then continuously weaved through the adjacent holes on top 33. A groove 32 provides a channel for the cord 10 to rest in. This lessens of a protrusion of the cord 10 on the top of the disk 31. The grooves 32 can also be applied to the original variation.

FIG. 8 shows partial cross section of the disk assembly with a circular cap 34 to create additional buoyancy. A circular cap 34 is inserted over an outer disk wall 36 and an inner disk wall 37. The inside portion of the outer disk wall 36 and the inner disk wall 37 have grooves where the cap 34 can snap into place. The resulting air space 35 provide for additional buoyancy.

FIG. 9 shows partial cross section of the disk using an insert 38 to create additional buoyancy. The insert is placed in between an outside wall 39 and an inside wall 40. The insert is made of any variety of buoyant material, such as air filled doughnut, foam rubber and/or foam.

FIG. 6 shows a concentric notch 29 that provide additional thickness to the top surface of disk 21. The inside edge of the disk 18 is where the person in distress hold onto, when being rescued. The notch 29 provides extra strength to this point.

The disk 18 is in the shape of an aerodynamic flying disk. The invention uses the aerodynamic shape to provide straight and accurate flight when the disk 18 is thrown.

The disk 18 and the cover 26 is made of a rigid plastic material, such as polyethylene, polypropylene, vinyl, nylon, rubber, various impregnated or laminated fibrous material, various plasticized materials, etc. The construction and makeup of the disk 18 and cover 26 can also include fibrous additives and any other additives to increase the rigidity and strength. The disk 18 and cover 26 can also be made of fluorescent and/or reflective materials to optimize the visibility. Similar colors that are associated with rescue can be used. A glow in the dark material can also be used to make the disk 18 and the cover 26 more visible in low light conditions. The line 10 can also be made of bright colors or glow in the dark material to optimize the visibility. The line 10 can also have light reflective material imbedded on the outside.

FIG. 10 shows a variation that allows for an electrical means to light the invention. The electrical lighting means is shown on a added buoyancy variation. A LED 41 is inserted on the outer peripheral edge of the disk 31. The LED 41 is connected to a switch/circuitry 43 and a battery pack 42. More than one LED 41 can be connected to the switch/circuitry 43 and battery pack 42. When the disk 31 is thrown, the centripetal force turns on the circuit and keeps it on. The micro circuit component of the switch/circuit 42 can make the LED 41 blink. The battery pack 42 holds one or more button sized batteries. More than one LED 41 can be connected to the same battery pack 42 and switch/circuit 43. The weight of the added LED 41, battery pack 42 and switch/circuit 43 is negligible, and minimally affect the flight of the disk 31. The LED 41 adds additional visibility, when rescue is performed in low light conditions. The light up variation can also be applied to the disk 18 variation, where extra buoyancy is not added.

The size of the disk 18 and the thickness of the cord can dictate how long of a reach the Flying Disk Rescue Device can have. By varying the two factors, the invention can be optimized for the different uses. A Flying Disk Rescue Device with a 4 mm line and enough line to reach of 50 feet will have a disk body of 15 inch diameter. This measurement is roughly the same for both added buoyancy and no added buoyancy variations.

In the typical embodiment of the invention, the components of the invention make the disk 18 buoyant to neutrally buoyant. Main application of this invention is for speedy rescue, rather than to provide for floatation device. In instances where buoyancy is needed, the additional buoyancy variation can be used.

All the materials that make up the invention are fairly inexpensive and lightweight. The main body of the disk unit is made up of the disk 18 and the cover 26, which are solid pieces. There are no tools required to reassemble the invention after deployment. The double sided adhesive pads 24 and 28 can be easily replaced. Existing double sided adhesive pads can be reconditioned, by adding a reposition able adhesive on top. This provides for a simple, inexpensive and reusable rescue device.

Operation

The Flying Disk Rescue Device is kept inside a padded container, such as a cardboard box or a plastic container. The padding will provide gentle pressure on top of the spirally wound line 10, preventing the line 10 from unwinding from the top surface of the disk during transport.

The invention is used when an individual is distressed in and around water. The Flying Disk Rescue Device is removed from the container. The rescuer connects the clip 11 onto an anchored structure, such as a fence or a railing. If there is a tree with considerable thickness to be sufficient to act as an anchor, the length of line 10 between the clip 11 and the handle 14 can be wrapped around the tree and the clip 11 snapped onto the ring 17. If there is no anchoring point, the speed of the rescue is priority or anchoring is not crucial to the rescue, the clip 11 can be dropped onto the floor. With the throwing hand, the rescuer grabs onto the disk 18. The non throwing hand grabs onto the tube 17 portion of the handle 14. With the similar throwing motion of a flying disk toy, such as a Frisbee™, the rescuer launches the disk 18 into the air. The disk 18 moving away from the thrower will unwind the line 10 automatically. The throwing motion will also automatically remove the cover 26, when the spirally wound line 10 reaches the loop 27. Spiral winding of the line 10 minimizes excessive tension on the line when it is thrown. Excessive tension can adversely affect the path of the disk. The spiral winding of the line 10 also minimizes the chance of entanglement.

If the victim is in swift moving water, the rescuer can lead the throw. The disk can also be thrown pass the person of distress and then the line 10 pulled in to bring the disk 18 closer to the victim. The hole 20 in the middle of the disk 18 makes it easier to grab onto the disk. The person in distress can also hold onto the disk 18 by putting an arm into the hole 20. The person in distress can then bend the elbow joint to hold onto the disk. Exposure to cold waters can bring hypothermia. Often the victim looses the strength to grab onto an object with the hands. The use of a larger joint, such as an arm and bending of said arm at the elbow, the person in distress can easier to hold onto the disk 18.

If the disk 18 is thrown off target and the pulling in of the line 10 cannot bring the disk 18 closer to the victim, the rescuer can pull in the entire length of the line 10 in and re-throw the disk 18, without the line 10 being spirally wound. This technique is less accurate and less efficient, but provides an additional chance to reach the person in distress. Once the person in distress has a secure hold of the disk 18, the rescuer can pull in the line 10, by pulling hand over hand. The hand with the handle 14 can act as the main pulling hand. The cushioning provided from the tube 16 and the strapping 15 will minimize stress put on the hand during the pulling in of the line 10.

The typical embodiment of the invention and the additional buoyancy variation of the invention can be both used similarly as described above.

Once the Flying Disk Rescue Device is deployed and the rescue is complete, the line 10 can be rewound and the invention reused. If the tackiness on the surface of the double sided adhesive pads 24 and 28 has become insufficient to hold the line 10 in place, the double sided adhesive pads 24 and 28 can be replaced. A reposition able adhesive can also be applied to the existing tops of the double sided adhesive pads 24 and 28 to increase the tackiness.

The invention can also be used to string a guide line from one span to another. Such applications can be used in areas of tree care, construction and mountain climbing. The user can throw the disk from one span to another. The clip 11 can be connected to the end of a cord that is being spanned. The disk 18 can be pulled in to complete the spanning of the attached cord.

Conclusion, Ramifications, and Scope

The description provided above shows a quick and accurate hand thrown rescue device that uses the aerodynamic shape flying disk to provide a quick rescue for those in distress. The quickness and accuracy of deployment makes this device ideal for quick water and thin ice rescue. Often the first person at the scene of distress does not have the proper tool to perform the rescue by himself. The simplicity of the invention allows for a single individual to perform the rescue. The spiral winding of the line allows for even dispensing of the line, thus minimizing the entanglement of the line as well as minimally affecting the path of the disk. The spiral winding also allows for both right and left handed users. The hole in the middle of the disk allows for easy grabbing of the disk body. It also provides a more efficient way to grab onto the disk. The person in distress can insert an arm into the hole and fold the elbow joint. The invention offers an easy way to secure one end of the line to an anchored object. The invention can easily adapt for many variety of rescues. The size of the disk can be increased to allow for additional length of a the line. Variations to the invention can also provide additional buoyancy.

Although the descriptions mentioned above describe specific applications, these should not be deemed as limiting the scope of the invention, but as to merely illustrating some of the presently preferred embodiments of the invention. For example, the invention can be used for other applications, such as rock climbing, construction and tree care. The invention can also be adapted for a toy application.

The scope of the invention should be determined by the claims and their legal equivalents, rather than from the examples given.

I claim:

1. A device, to be deployed by a user for rescuing individual in and around a body of water comprising:

a) a generally disk shaped body having a surface and a peripheral edge; and b) a hole in the middle of said surface; and c) a circular disk that covers said hole; and d) a length of line having $1^{st}$ and $2^{nd}$ ends, where said line is spirally wound on top of said surface and said circular disk; and e) means for securing said line to said surface and said circular disk; and f) means for connecting said $1^{st}$ end of said line to said disk shaped body; and g) means for retaining said $2^{nd}$ end of said line by the user during the deployment of the device.

2. The device of claim 1 wherein said disk shaped body has at least one light source of an electronic means on said surface, whereby said at least one light source of an electric means is activated by the centripetal force created during the deployment of said device.

3. The device of claim 1 wherein said means for securing said line to said surface and said circular disk comprises an adhesive material.

4. The device of claim 3 wherein said adhesive material being double-sided.

5. The device of claim 4 wherein said adhesive material being a glue material.

6. The device of claim 1 wherein said means for connecting said $1^{st}$ end of said line to said disk shaped body comprises at least one hole on said disk shaped body for weaving said line through said at least one hole.

7. The device of claim 1 wherein a clip is attached to said $2^{nd}$ end of said line.

8. The device of claim 7 wherein said means of retaining said $2^{nd}$ of said line during deployment said device includes a handle attached to said line.

9. The device of claim 8 wherein a ring is attached to said handle whereby said clip can attach to the ring.

10. The device of claim 1 wherein said circular disk has a loop attached thereon.

11. The device of claim 10 wherein said loop is attached to said line, whereby during the deployment of said device, said circular disk is lifted off of said hole.

12. A device, to be deployed by a user for rescuing individual in and around a body of water comprising:

a) a generally disk shaped body having a top surface, bottom surface, convex upper edge and a concave lower edge; and b) a projection on said bottom surface concentric to said concave lower edge, thereby creating a channel; and c) a hole in the middle of said top surface; and d) a circular disk that covers said hole; and e) a length of line having $1^{st}$ and $2^{nd}$ ends, where said line is contiguously spirally wound on top of said top surface and said circular disk; and f) means of securing said line to said top surface and said circular disk; and g) means for connecting said $1^{st}$ end of said line to said disk shaped body; and h) means for retaining said $2^{nd}$ end of said line by the user during the deployment of device.

13. The device of claim 12 wherein a circular cap span between said projection and said concave lower edge thereby sealing up said channel and creating an air space and further providing buoyancy.

14. The device of claim 12 wherein an insert made of buoyant material is placed between said projection and said concave lower edge thereby filling up said channel and further providing buoyancy.

15. A method of deploying a device by a user for rescuing individual in and around a body of water comprising:

(a) providing a throw able rescue device comprising of a generally disk shaped body, a hole in said body, a circular disk covering said hole, a line attached to said disk body, a handle with a ring attached to said line and a clip attached to the end of said line, (b) grabbing said device with either right throwing hand or left throwing hand, (c) grabbing said handle with the non throwing hand, (d) throwing said device toward a person in distress, whereby said line is automatically dispensed, (e) inserting said clip to said ring so that said line can be wrapped around an anchoring object.

* * * * *